United States Patent [19]

Farb

[11] 4,386,563

[45] Jun. 7, 1983

[54] PRINTING SYSTEM HAVING STAGGERED HAMMER RELEASE

[75] Inventor: Norman E. Farb, Villa Park, Calif.

[73] Assignee: Printronix, Inc., Irvine, Calif.

[21] Appl. No.: 279,688

[22] Filed: Jul. 2, 1981

[51] Int. Cl.[3] ..... B41J 7/70

[52] U.S. Cl. ..... 101/93.04; 101/93.09; 101/93.48

[58] Field of Search ..... 101/93.03, 93.04, 93.05, 101/93.09, 93.14, 93.23, 93.29, 93.34, 93.48, 93.16

[56] References Cited

U.S. PATENT DOCUMENTS

| | | | |
|---|---|---|---|
| Re. 30,515 | 2/1981 | Curtiss et al. | 101/93.14 |
| 3,672,297 | 6/1972 | Berglund et al. | 101/93.09 |
| 3,941,051 | 3/1976 | Barrus et al. | 101/93.04 |
| 3,952,648 | 4/1976 | Sery et al. | 101/93.14 |
| 4,055,117 | 10/1977 | Munday | 101/93.09 X |
| 4,150,619 | 4/1979 | Hasler et al. | 101/93.14 X |
| 4,235,167 | 11/1980 | Staugaard | 101/93.09 |
| 4,258,623 | 3/1981 | Barrus et al. | 101/93.04 |
| 4,315,460 | 2/1982 | Sato | 101/93.48 X |

OTHER PUBLICATIONS

Dond, IBM Tech. Discl. Bulletin, vol. 17, No. 4, Sep. 1974, pp. 1012–1013.

*Primary Examiner*—Edward M. Coven
*Attorney, Agent, or Firm*—Fraser and Bogucki

[57] ABSTRACT

In an impact printer system in which various hammer springs mounted in side-by-side relation along a reciprocating hammer bank are selectively released to cause an impact tip mounted at the upper end of the hammer spring to impact a paper or other printable medium, the hammer springs are divided into two different groups and the release of the hammer springs in the different groups is staggered. Alternate ones of the hammer springs comprise a first group of hammer springs which are selectively released at the beginning of each of a succession of cycles as the hammer bank sweeps across the printable medium. The remaining ones of the hammer springs comprise a second group and are releaseable at a midway point through each cycle. When any given hammer spring is released, an electro-mechanical mutual inductance effect is released in which the adjacent hammer springs and associated pole pins provide a beneficial improvement in the mutual inductance, and the current required to release each hammer spring and the total power required to operate the hammer bank are significantly reduced. To compensate for the staggered release of the hammer springs, the hammer springs are located to provide other than uniform spacing between the impact tips. The impact tip on each hammer is spaced a first fixed distance from the impact tip on the adjacent hammer on one side thereof and a second fixed distance from an impact tip on an adjacent hammer on the other side thereof. The difference between the first and second fixed distances is equal to the distance that the hammer bank travels relative to the printable medium during each of the succession of cycles.

11 Claims, 13 Drawing Figures

PRINTING SYSTEM HAVING STAGGERED HAMMER RELEASE

HISTORY OF THE PRIOR ART

It is known to provide an impact printer system in which hammer springs mounted along the length of a hammer bank undergoing reciprocating motion relative to a print paper or other printable medium are selectively released to impact the printable medium with dot printing tips at the upper ends of the hammer springs. An example of such a printing system is provided by U.S. Pat. No. 3,941,051 of Barrus et al. The printer system described in the Barrus et al. patent utilizes a reciprocating hammer bank which is comprised of an elongated permanent magnet mounted along the lower end of an upstanding common magnetic return path member. The lower ends of the hammer springs are coupled to the permanent magnet opposite the common magnetic return path member to mount the hammer springs in side-by-side relation along the length of the permanent magnet. Dot printing impact tips are mounted on the hammer springs adjacent the upper ends thereof. A plurality of pole pieces or pins are mounted in spaced-apart relation along the top portion of the common magnetic return path member opposite the permanent magnet such that each pole pin is disposed adjacent the top end of a different one of the hammer springs. A different magnetic coil surrounds each of the pole pins.

In the absence of energization of the magnetic coils in the structure of the Barrus et al patent, magnetic flux from the permanent magnet travels through a path including the hammer spring, the pole pin and the common magnetic return path member to hold each of the hammer spring in a retract position oagainst the adjacent pole pin. Release of a given hammer spring is accomplished by momentary energization of the coil surrounding the pole pin against which the hammer spring is held in the retract position. Such momentary energization overcomes the effects of the permanent magnet long enough to drive the hammer spring away from the pole pin and toward the printable medium with the impact tip eventually impacting the printable medium to print a dot thereon. Following impact, the hammer spring returns to the retract position against the pole pin.

As the hammer bank traverses across the printable medium in printer systems of the type shown in the Barrus et al. patent, a succession of release cycles is defined with the beginning of each cycle corresponding to a different possible dot position across the width of the printable medium. At the beginning of each release cycle, selected ones of the hammer springs are released in accordance with incoming data to be printed. It has been found that many common printing operations require that a substantial number or even all of the hammers be simultaneously released at the beginning of some and in many cases most of the release cycles. This is particularly true where the printer system is caused to operate in a plot mode in which the printing of many dark or shaded areas may be required.

It has been found that when large numbers of the hammer springs must be simultaneously released the magnetic characteristics of the hammer bank and thereby the release characteristics of the hammer springs are affected by the number of hammer springs being simultaneously released. It has been observed, for example, that the amount of current which must be applied to the coils to effect satisfactory hammer spring release varies in direct relation with the number of hammers being simultaneously released. In order to provide uniform release characteristics and thereby uniform printing, it may be necessary to vary the duration of the release current pulse to the coils of hammer springs to be released in direct relation to the number of hammer springs to be simultaneously released at a given instant. An arrangement for accomplishing this is described in a copending application of Barrus et al., Ser. No. 81,559, filed Oct. 3, 1979 and commonly assigned with the present application. The arrangement shown in the Barrus et al. application sets a counter at a preset value representing the minimum duration of the coil drive current pulse, then counts the counter down in response to the input data and in accordance with the number of hammer springs that are to be released at the beginning of the next cycle. At the beginning of the next cycle, the counter is counted up and the current drive pulse to the coils remains on as long as the counter is counting up. In this manner generally uniform hammer spring release and impacting is achieved in the face of constantly changing numbers of the hammer springs being simultaneously released during a printing operation.

Despite the substantial inprovement in performance provided by the arrangement described in the Barrus et al application there are still various aspects of the hammer bank operation which could be improved. For example, the current required for continued release of large numbers of the hammer springs is substantial, resulting in a relatively large power consumption by the printer system. The large power consumption is accompanied by a substantial buildup of heat in the coils and surrounding areas of the hammer bank, requiring use of heat sink fins or other devices in conjunction with the coils to dissipate the heat. Still further problems reside in the complex circuitry required to handle the relatively large currents required for the release of large numbers of the hammer springs. Such problems are further magnified in the case of certain recent high speed, high performance printer systems of the type described in the Barrus et al. patent in which the number of hammer springs in the hammer bank is increased and the hammer springs themselves are spaced closer together.

Accordingly, it would be desirable to provide an impact printer system in which relatively large numbers of the hammer springs can be simultaneously released using relatively small amounts of current and a relatively small amount of total power. It would furthermore be advantageous to provide an impact printer system in which the magnetic properties and characteristics of the hammer bank structure are improved, and particularly in which the magnetic performance of existing structures is improved with relatively minor modification and without the need for substantial redesign of the hammer bank structure or a substantial addition of parts and componentry.

BRIEF DESCRIPTION OF THE INVENTION

The above and other objects are accomplished in accordance with the invention by an impact printer system in which release of the hammer springs is staggered. This is done without in any way slowing down or otherwise impairing the performance characteristics and particularly the printing speed of the printer system. The staggered firing of the hammer springs is the result of a recognition that the magnetic characteristics of the hammer bank structure are greatly improved if adjacent hammer springs are not normally required to be fired simultaneously.

When a hammer spring release coil is energized, the resulting magnetic flux in the pole pin cancels the effects of the magnetic flux from the permanent magnet at the pole pin-hammer spring interface so that release of a given hammer spring is effected. At the same time, the flux from both the coil and the permanent magnet must travel a return path of least reluctance which is comprised of the adjacent hammer springs and the pole pieces associated therewith. When the adjacent hammer springs are released simultaneously with the given hammer spring, the flux return paths defined by the adjacent hammer springs and their associated pole pins are magnetically saturated or nearly saturated so as to define magnetic return paths of high reluctance. The result is a limited inductance, a limitation in the amount of cancelling flux from the coil and a resulting requirement for a relatively large current and the high power consumption which accompanies it. On the other hand if the adjacent hammer springs on both sides of the given hammer spring have already been released, have impacted the printable medium and are at least beginning their return to the retract position against the adjacent pole pins, the magnetic return paths defined thereby are relatively unsaturated and thereby of relatively low reluctance. In addition the electro-mechanical mutual inductance of the two coils in such magnetic return paths creates a current in the releasing coil in the direction of aiding the release as the adjacent hammer springs on both sides of the given hammer spring return to their pole pins.

It has been found that when adjacent hammer springs have not been fired at all or have been fired early enough to provide for impact and at least partial return to the retract position, a given hammer spring can be released in a highly satisfactory manner using a relatively small amount of release current. The overall result is that relatively small amounts of power are required to operate the hammer bank. Because of the relatively unsaturated return paths, the inductance of the magnetic circuit is large and the canceling flux which provides hammer spring release builds up relatively quickly to a large value.

In accordance with the invention, these observations are put into practice by staggering the release of the hammer springs within the hammer bank. More specifically, alternate ones of the hammer springs are made eligible for release in response to the incoming data to be printed at the beginning of each of the succession of dot printing cycles defined as the hammer bank sweeps across the printable medium. The remaining ones of the hammer springs are eligible for release at a point in time half way through each of the cycles. The firing times for the two different groups of hammer springs are thereby separated sufficiently so that hammer springs of the first group which are fired at the beginning of each cycle have a chance to impact and at least partially return to the retract position before hammer springs in the second group are released at the halfway point in the cycle. If the first group of hammer springs is comprised of the odd numbered hammer springs along the length of the hammer bank, hammer springs within such group to be released will be released at the beginning of each of the cycles and will be at least partly returned to the retract position when selected ones of the even numbered hammer springs along the length of the hammer bank are released at a point halfway through the cycle.

To compensate for the staggered release of the hammer springs, the distance between the impact tips of adjacent hammer springs which is normally a standard, uniform distance is varied so that each impact tip is a first fixed distance from the impact tip of the hammer spring on one side thereof and a second fixed distance from the impact tip of the hammer spring on the other side thereof. The first and second fixed distances differ by an amount equal to the distance traveled by the hammer bank across the printable medium during each cycle. Accordingly, when hammer springs in the second group are released at the halfway point in each cycle, the impact tips of such hammers are in the same location relative to the printable medium that they would be in if the spacing between each adjacent pair of impact tips was uniform and all of the hammer springs in the bank were releasable simultaneously at the beginning of each cycle.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
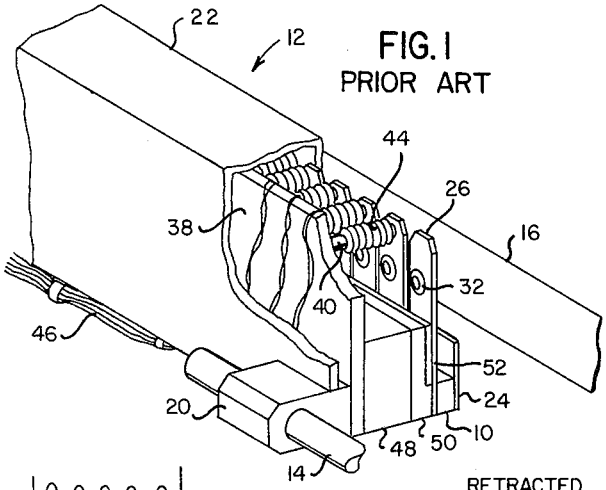
FIG. 1 PRIOR ART
FIG. 1 is a perspective, partly broken away view of a hammer bank utilized in accordance with the invention.

FIG. 1 depicts a hammer bank 10 in accordance with the invention. The hammer bank 10 forms the major part of a reciprocating shuttle 12 which is similar to the shuttle shown and described in the previously referred to U.S. Pat. No. 3,941,051 of Barrus et al. The Barrus et al patent also shows and describes in detail the printer system in which the shuttle and its included hammer bank 10 of FIG. 1 are used.

The shuttle 12 includes opposite horizontal support shafts 14, one of which is shown in FIG. 1. The opposite horizontal support shafts 14 are received in linear bearings to support the shuttle 12 for reciprocating movement relative to an ink ribbon 16 and a printable medium in the form of a paper 18 as described in the Barrus et al. patent. The shaft 14 is coupled by a bracket 20 to a horizontal channel member defining a shuttle mechanism cover 22 extending along the printing line position. The cover 22 includes a front face 24 on the side opposing the ink ribbon 16. As described in detail in the Barrus et al. patent a force-balanced cam drive is used to reciprocate the shuttle 12 relative to the ink ribbon 16 and the paper 18.

Figure 2:
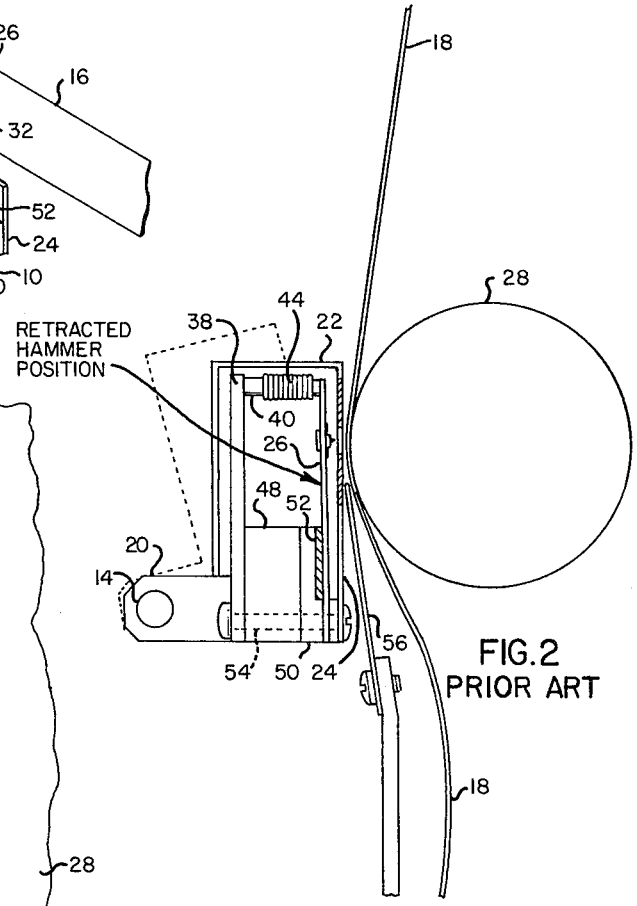
FIG. 2 PRIOR ART
FIG. 2 is an end view of the hammer bank of FIG. 1.
Figure 3:
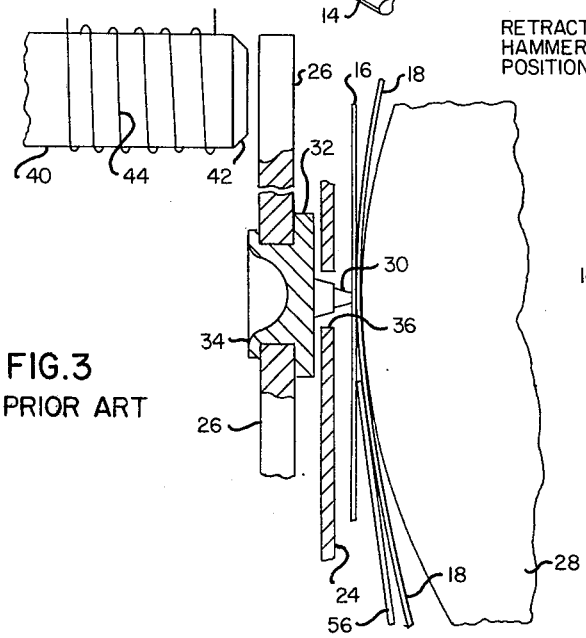
FIG. 3 PRIOR ART
FIG. 3 is a side view of a portion of the hammer bank of FIG. 1 illustrating certain details thereof.

The hammer bank 10 includes a plurality of hammer springs 26 which are elongated, resilient magnetic spring elements mounted at a lower fixed end in spaced-apart relation along a horizontal axis. Each of the hammer springs 26 is vertically disposed and terminates in a movable free end. The hammer springs 26 are of magnetic material of approximtely 0.032" thickness, and each lies approximately tangential to a platen 28 disposed on the opposite side of the paper 18 and providing a backing support for receiving the impact of the hammer springs 26. Each of the hammer springs 26 includes a dot matrix printing tip 30 extending normal from the surface of the hammer spring 26 in the direction for the ink ribbon 16 and the paper 18. The tip 30 is suitably small for the chosen matrix, being of approximately 0.016" diameter in the present example. The tips 30 of the successive hammer springs 26 lie along a selected horizontal line substantially radial to the adjacent arc of the curved surface of the platen 28 and defining the printing line position. When retracted, each tip 30 is disposed slightly behind the front face 24 of the shuttle cover 22 as best seen in FIG. 2. The dot matrix printing tip 30 is a wear resistant wire or hardened tool steel element which may be affixed by various means to the hammer springs 26. A convenient mounting is depicted in FIG. 3 in which the tip 30 is intergral or secured to a base disk 32 having an outwardly directed flange portion relative to the tip, with the flange 34 being curved about the inner surface defining an aperture in the hammer springs 26 so as to rivet the bask disk 32 and coupled hammer tip 30 to the hammer spring 26. Preferably, the tip 30 is mounted at that longitudinal position along the length of the hammer spring 26 that defines the center of percussion of the hammer spring 26. When impacting, as in the position of FIG. 3, the tip 30 alone extends through an aperture 36 in the cover face 24.

In the hammer bank 10, a planar common magnetic return path member 38 is mounted in parallel, spaced-apart relation to the hammer springs 26 on the opposite side from the hammer tips 30. Individual pole pieces or pins 40 having tapered pole tipe 42 extend outwardly from the return path member 38 into close juxtaposition to the different individual hammer springs 26. Each hammer spring 26 is in contact and in magnetic circuit with the adjacent magnetic pole piece 40 when in the retract position. Energizing coils 44 are individually wound about each of the pole pieces 40, adjacent the tapered pole tip 42, with leads from the coils conveniently being joined to terminals and printed circuit conductors (not shown in detail) on the common return path member 38. External conductors to associated circuits are physically coupled together in a harness 46 extending outwardly from the shuttle 12 to the associated driving circuits. The harness 46 reciprocates along its length with the motion of the shuttle 12.

The magnetic circuit in the hammer bank 10 also includes a common permanent magnet 48 of elongated bar form, disposed between the return path member 38 and a magnetic insert 50 which abuts the fixed bottom end of each hammer spring 26. The magnetic insert 50 has an offset upper portion in which is disposed a resilient damping element 52, such as butyl rubber, abutting the hammer surface immediately above the fixed region but not impeding the curvature in the retract position.

The hammer bank 10 operates by individually releasing the hammer springs 26 from a retract position in which the springs 26 are held against the facing pole tips 42. A closed loop magnetic path is normally defined by the permanent magnet 48, the return path member 38, the individual pole pieces 40, the hammer springs 26, and the insert 50. When retracted, the hammer springs 26 are held with the impact tips 30 out of engagement with the ribbon 16 and slightly behind the front face 24 as previously described. The moving ink ribbon 16 bears against the front face 24. When a given coil 44 is energized, the magnetic field in the individual circuit is neutralized adjacent the upper free end of the hammer spring 26, and the hammer spring 26 is released. The spring effect of the hammer spring 26 causes it to fly with a predetermined velocity and flight time to impact the tip 30 against the ribbon 16 and underlying paper 18. The motion and force are both predictable and controllable, inasmuch as they result only from the constant spring characteristic of the hammer spring 26 and the distance of its flight.

As seen in FIG. 2 the base of the magnetic structure of the hammer bank 10 is coupled together by tie bars 54 horizontally spaced along the length of the hammer bank 10. The paper 18 is held against the surface of the platen 28 adjacent the impact tips 30 by a plurality of spring fingers 56 which extend upwardly from underneath the platen 22 into tangential engagement with the surface of the platen 28 just below the printing line position.

Figure 4:
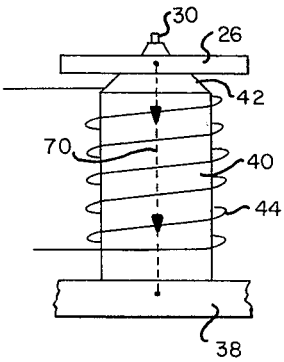
FIG. 4 is a top view of a portion of the hammer bank of FIG. 1 illustrating the retract magnetic flux provided by the permanent magnet of the hammer bank.

FIG. 4 is a top view of one of the hammer springs 26 and its associated pole piece 40 showing the hammer spring 26 held in the retract position against the tapered pole tip 42. The permanent magent 48 shown in FIGS. 1 and 2 creates a magnetic field through the hammer spring 26, the pole piece 40 and the return path member 38 as previously discussed. This magnetic field is accompanied by a flow of magnetic flux upwardly along the hammer spring 26, across the pole piece 40 and then into and downwardly through the return path member 38. This flow of flux is represented by a dashed line 70 in FIG. 4. Several arrowheads along the dashed line 70 represent the direction of flux flow.

Figure 5:
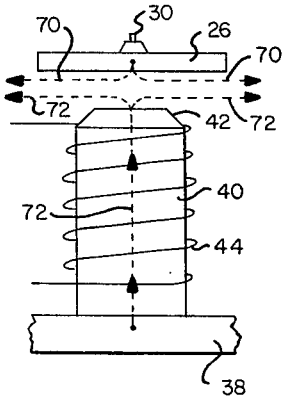
FIG. 5 is a top view of a portion of the hammer bank of FIG. 1 illustrating the canceling effect of the magnetic flux from the coil on the retract flux from the permanent magnet.

FIG. 5 depicts the magnetic conditions which occur when the hammer spring 26 is released. Energization of the coil 44 results in a counterflowing magnetic flux which is represented by a dashed line 72. Several arrowheads associated with the dashed line 72 indicate that the flux produced by energization of the coil 44 flows in an opposite direction from the flux produced by the permanent magnet 48. The flux from the permanent magnet 48 and the flux from the coil 44 effectively meet head on at the interface of the hammer spring 26 and the pole tip 42. It is in this manner that the flux produced by energization of the coil 44 is said to momentarily neutralize the flux from the permanent magnet 48, thereby releasing the hammer spring 26 from the retract position. The resiliency of the hammer spring 26 causes it to pull away from the retract position and eventually impact the tip 30 through the ink ribbon 16 onto the paper 18.

The flux from the energized coil 44 is said to neutralize the flux from the permanent magnet 48 at the gap between the hammer spring 26 and the pole piece 40 because the net result is virtually zero flux in a direction perpendicular to the pole tip 42. At the same time the diverted flux from the coil 44 and the permanent magnet 48 must have a return path. Because both fluxes are diverted to the opposite sides of the hammer spring 26 and the pole piece 40 as depicted by the dashed lines 70 and 72 in FIG. 5 and because air has a much higher reluctance than magnetic material, the return paths of least resistance are provided by the adjacent hammer springs and their associated pole pieces. The small air gaps between adjacent hammer springs and between the hammer springs and the adjacent pole pieces when the springs are released do not greatly increase the overall reluctance of an otherwise low reluctance path provided by the hammer springs and pole pieces. However, the reluctance of these return paths varies with the degree of magnetic saturation thereof as determined by when the hammer springs were last released.

Figure 6:
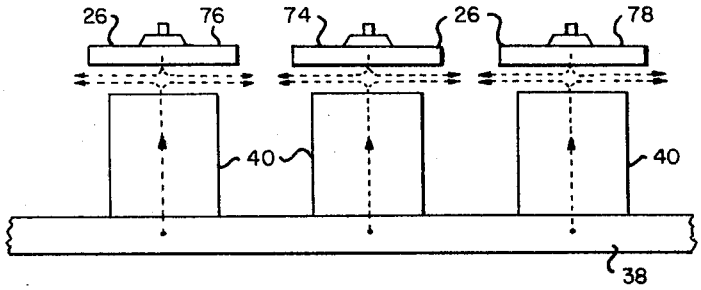
FIG. 6 is a top view of a portion of the hammer bank of FIG. 1 illustrating the flux pattern for simultaneous release of adjacent hammer springs.

If upon release of a given hammer spring 26 an adjacent hammer spring is being simultaneously released, the adjacent hammer spring and its associated pole piece are magneticlly saturated and provide a relatively high reluctance return path for flux from the given hammer spring. FIG. 6 depicts the magnetic condition which exists when three adjacent hammer springs 26 are simultaneously released. The fluxes from a center one 74 of the hammer springs 26 are directed toward a left one 76 of the hammer springs 26 and toward a right one 78 of the hammer springs 26. However the left and right ones 76 and 78 of the hammer springs 26 and their associated pole pieces 40 are magnetically saturated because of the simultaneous release action occurrng therein. For that matter, part of the flux at the left one 76 of the hammer spring seeks out the center one 74 of the hammer spring 26 and the associated pole piece 40 for a return path, as does part of the flux at the right one 78 of the hammer springs 26.

Figure 8:
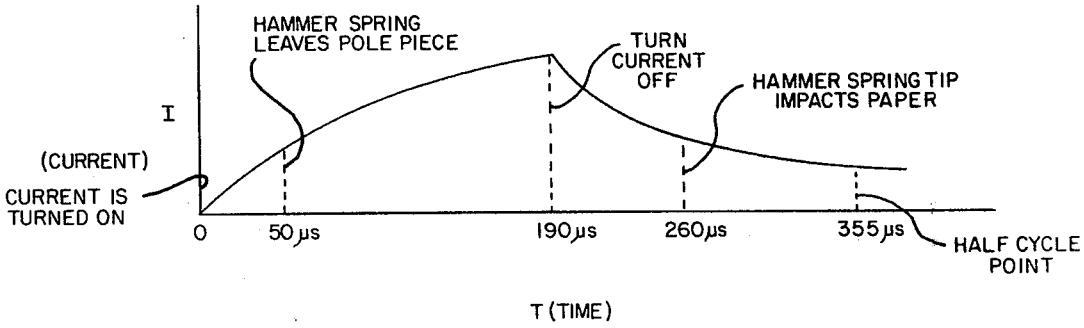
FIG. 8 is a diagrammatic plot of coil current as a function of time during a standard hammer spring release cycle.

Because of the high reluctance in the return paths when the condition depicted in FIG. 6 exists, the current supplied to the coils 44 must be relatively large and of relatively long duration. A typical release current applied to one of the coils 44 is depicted in FIG. 8 as a function of time. When the current is first turned on in response to a command to release the hammer spring, the current begins to increase in magnitude. At a point in time approximately 50 microseconds later, the current reaches a magnitude which is large enough to cause the hammer spring 26 to begin leaving the pole piece 40. Thereafter, the current continues to increase in magnitude to help the hammer spring 26 flex away from the retract position and into the impact position. At a point in time approximately 190 microseconds after the current is first turned on, the current is turned off and begins to decrease in magnitude as shown in FIG. 8.

At a point in time approximately 260 microseconds after the current is first turned on, the tip 30 on the hammer spring 26 impacts the ink ribbon 16 and the paper 18. At this point the current is continuing to decrease in magnitude and continues to decrease still further with time. A point 355 microseconds after the current is first turned on is defined as a half cycle point in a cycle which is of 710 microseconds duration. The 710 microsecond cycle is defined by the time required for each of the impact tips 30 to travel from a dot position to the next dot position along a print line on the paper 18 as the shuttle 12 traverses across the paper 18. Accordingly, if a hammer spring 26 is released so as to impact the paper 18 and print a dot at a given dot position, the hammer spring 26 must be capable of release, impact and return within 710 microseconds so that the cycle can be repeated if the hammer spring is to be released at the next dot position. In the present example each hammer spring 26 is capable of release, impact and return within the 710 microsecond cycle. Each print line across the width of the paper 18 is comprised of a succession of the 710 microsecond cycles.

Figure 7:
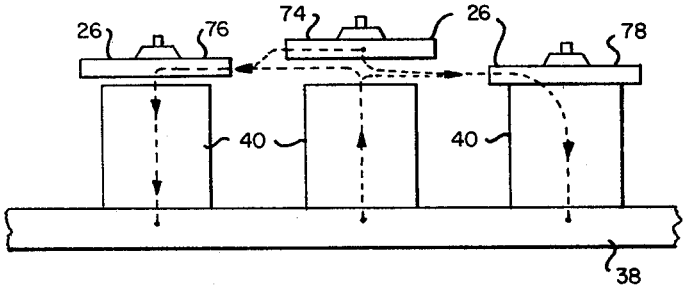
FIG. 7 is a top view of a portion of the hammer bank of FIG. 1 illustrating the flux pattern achieved with staggered hammer release.

FIG. 7 depicts the magnetic condition in which the center one 74 of the hammer springs 26 is fired 355 microseconds after firing of the left one 76 of the hammer springs 26 with the right one 78 of the hammer springs 26 not being fired at all. As in the case of each of the hammer springs depicted in FIG. 6, the center one 74 of the hammer springs in FIG. 7 has flux at the opposite sides thereof searching for a low reluctance return path. As described in connection with FIG. 8, the impact tip 30 on the hammer spring 26 typically impacts at a point in time 260 microseconds after release of the hammer spring, after which the hammer spring begins its return to the retract position. As the hammer spring 26 begins its return, the magnetic flux within the hammer spring and the associated pole piece has been substantially dissipated and the hammer spring and pole piece are no longer magnetically saturated. Accordingly, the flux at the left side of the center one 74 of the hammer springs 26 finds a relatively low reluctance path in the form of the left one 76 of the hammer springs 26 and its associated pole piece 40. The flux at the right side of the center 174 of the hammer springs 26 finds a low reluctance path in the form of the right one 78 of the hammer springs 26 and its associated pole piece 40, the right one 78 of the hammer springs 26 not having been fired at all. However, if the right one 78 of the hammer springs had been fired at the same time as the left one 76 of the hammer springs 26 was fired it would be at a point in its cycle where it would still provide a low reluctance return path for flux from the center one 74 of the hammer springs 26.

Figure 9:
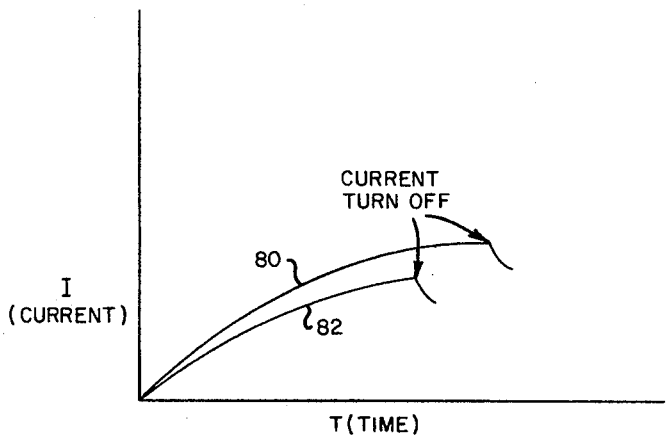
FIG. 9 is a diagrammatic plot of coil current as a function of time illustrating the reduced current requirement provided by the invention.

It has been found that under the conditions depicted in FIG. 7 the current required to provide acceptable release of the center one 74 of the hammer springs 26 is of lower magnitude and shorter duration than the current required to provide acceptable release of any of the hammer springs 26 under the conditions depicted in FIG. 6. This is illustrated in FIG. 9 in which a first curve 80 represents the waveform corresponding to the current waveform of FIG. 8 and representing the current required under the conditions depicted in FIG. 6. A second curve 82 in FIG. 9 depicts the current required to release the center one 74 of the hammer springs 26 under conditions depicted in FIG. 7. It will be seen that considerably less current is required in the case of FIG. 7 than the case of FIG. 6. If all of the hammer springs 26 can be released under the conditions of the center one 74 of the hammer springs 26 of FIG. 7, then not only will the current requirements be greatly reduced but the overall power required to operate the hammer bank will be substantially reduced.

Such greatly improved conditions are accomplished in accordance with the invention by dividing the hammer springs 26 of the hammer bank 10 into two different groups and staggering the firing or release of those groups. The first group of the hammer springs 26 is comprised of the alternate ones or odd numbered hammer springs along the length of the hammer bank 10. The second group of the hammer springs 26 is comprised of the remaining intervening hammer springs which are the even numbered hammer springs along the length of the hammer bank 10. The first group of hammer springs is eligible for release only at the beginning of each of the 710 microsecond cycles. Conversely, the hammer springs within the second group are eligible for release only at the half cycle point within each of the cycles. This insures that when a given hammer spring is released, the adjacent hammer springs on opposite sides thereof are either in the retract position or returning thereto so as to provide the low reluctance magnetic return paths illustrated in FIG. 7.

The differences in operation between FIGS. 6 and 7 can be explained in terms of the permeability, $\mu$, of the magnetic materials comprising the hammer springs 26, the pole pieces 40 and the return path member 38. Permeability of magnetic materials is expressed by the formula $B=\mu H$. Such magnetic materials may be driven into a region on the standard B-H curve for magnetic materials where B reaches a maximum value and the material is said to be saturated. Thereafter, as H increases, the permeability $\mu$ must decrease. At the same time the inductance L of a magnetic circuit can be expressed by the relationship $L \propto (\phi/i)$ where $\phi$ is the magnetic flux and i is the current. It is well known the $\phi$ is a factor of the permeability $\mu$. Accordingly, the inductance L is directly affected by the permeability. For a given current, an increase in permeability results in a corresponding increase in inductance, and vice versa. It is for this reason that a given current will provide a much greater inductance under the conditions of FIG. 7 than in the case of FIG. 6. By the same token an adequate amount of inductance to provide acceptable hammer spring release results in a considerably lowered current requirement as reflected by the curves of FIG. 9.

Figure 10:
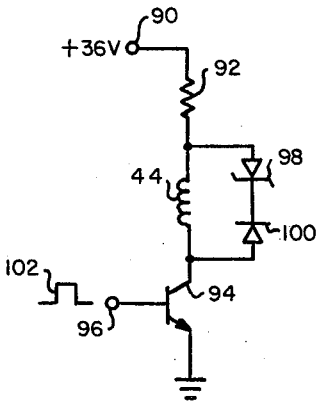
FIG.10 PRIOR ART
FIG. 10 is a schematic diagram of a conventional circuit for energizing each coil.

FIG. 10 depicts a conventional circuit used to energize each of the coils 44. The circuit includes a positive power supply terminal 90 coupled to the coil 44 through a 1.5 ohm fusistor 92. The opposite end of the coil 44 from the fusistor 92 is coupled to ground through an NPN transistor 94 having a base coupled to a terminal 96. Coupled in parallel with the coil 44 is the serial combination of a zener diode 98 and an oppositely poled blocking diode 100.

When the hammer spring associated with the coil 44 is to be released, a pulse 102 as shown in FIG. 10 is applied to the terminal 96 to render the transistor 94 conductive. With the transistor 94 conductive, current flows from the terminal 90 through the fusistor 92, the coil 44 and the transistor 94 to ground, thereby providing the desired energization of the coil 44. The leading edge of the pulse 102 corresponds in time with the 0 point on the curve of FIG. 8. The trailing edge of the pulse 102 occurs of the 190 microsecond point in FIG. 8 where the generation of coil current is terminated and such current begins to decay.

When the pulse 102 at the terminal 96 terminates and the transistor 94 is turned off, the inductive effect of the coil 44 causes a current to flow through the blocking diode 100 to the zener diode 98. The zener diode 98 acts like a constant voltage resistor and absorbs this current.

When staggered release of the hammer springs in accordance with the invention is accomplished, the current requirements are greatly reduced as previously described in connection with FIG. 9. Such reduced current requirements also result in simplification of the energizing circuit of FIG. 10. The smaller amount of current flowing into the coil for a shorter period of time results in a greatly reduced amount of current flowing through the blocking diode 100 to the zener diode 98 when the transistor 94 is turned off. Accordingly, it has been found that the zener diode 98 can be safely replaced with a resistor. The back EMF of an inductor such as the coil 44 can be expressed by the formula $E=L(di/dt)$. Because the inductance L is greatly increased in accordance with the invention, the back EMF E is also greatly increased, and as a consequence it has been found that the fusistor 92 can also be eliminated from the circuit of FIG. 10.

Figure 11:
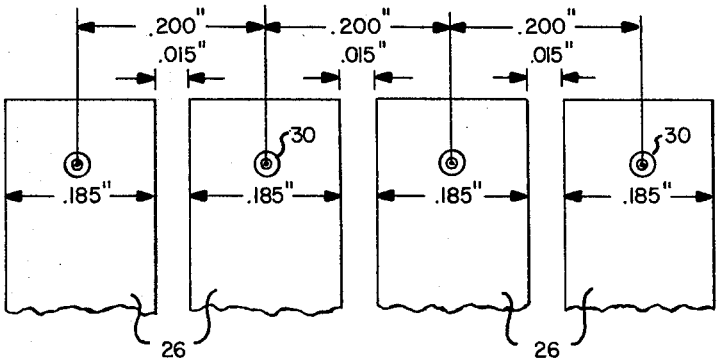
FIG.11 PRIOR ART
FIG. 11 is a front view of four of the hammer springs of the hammer bank of FIG. 1 illustrating conventional spacing of such hammer springs.

In the printer system shown and described in the previously referred to U.S. Pat. No. 3,941,051 of Barrus et al., the various different hammer springs are positioned in side-by-side relation along the length of the hammer bank in such a way that the distance between the impact printing tips of adjacent hammer springs is a fixed, uniform distance. The resulting arrangement is shown in FIG. 11 which depicts four different hammer springs 26. In the present example which comprises a later version of the printer system described in the Barrus et al. patent in which the number and the density of the hammer springs 26 are increased, each of the hammer springs is 0.185" wide and is spaced from the adjacent hammer springs by a distance of 0.015". The fixed, uniform distance between the impact printing tips 30 of adjacent ones of the hammer springs 26 is 0.200". In the arrangement of the Barrus et al. patent the hammer springs are subject to release only at the beginning of each of the succession of 710 microsecond firing cycles. The equidistant spacing of the impact printing tips 30 insures that each such tip is at one of the potential dot positions across the width of the paper 18 at the same point within each firing cycle.

Figure 12:
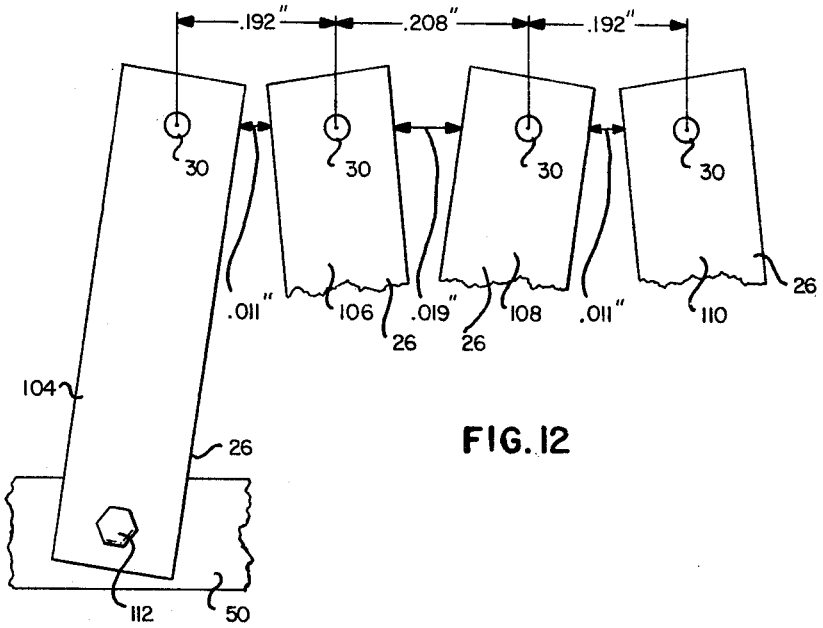
FIG. 12 is a front view of four of the hammer springs of the hammer bank of FIG. 1 illustrating the manner in which such hammer springs and included dot printing impact tips are positioned relative to each other in accordance with the invention.

In accordance with the invention half of the hammer springs 26 are subject to release at the beginning of each firing cycle and the remaining half of the hammer springs 26 are subject to release at the half cycle point in each cycle. In view of this the lateral positions of the upper ends of the hammer springs 26 and their included tips 30 are shifted laterally relative to the positions shown in FIG. 11 so that each of the impact tips 30 will be aligned with the various dot positions extending across the paper 18 when the various different hammer springs 26 are subject to release. The resulting arrangement is depicted in FIG. 12. FIG. 12 depicts first, second, third and fourth ones 104, 106, 108 and 110 respectively of the hammer springs 26. The hammer springs 104 and 108 are part of a first plurality of the hammer springs 26, and in FIG. 12 are inclined in one direction relative to vertical by an amount which is greatly exaggerated in FIG. 12 for simplicity of illustration. The hammer springs 106 and 110 form part of a second plurality of the hammer springs 26 and are inclined in the opposite direction from the vertical by an amount which is also greatly exaggerated in FIG. 12 for clarity of illustration. More specifically, the hammer springs 104 and 108 are shifted from the vertical positions shown by the four hammers in FIG. 11 such that the tips 30 thereof are shifted in the first direction by a distance of 0.04" from the positions of the tips 30 shown in FIG. 11. By the same token the hammer springs 106 and 110 are moved in the opposite direction a distance of 0.04" from the vertical positions of the tips 30 shown in FIG. 11. The result is that the standard spacing of 0.015" between adjacent hammer springs is reduced to 0.011" between the adjacent hammer springs 104 and 106 and between the adjacent hammer springs 108 and 110. On the other hand the distance between the hammer springs 106 and 108 is increased to 0.019". This has the effect of decreasing the distance between the tips 30 on the hammer springs 104 and 106 to 0.192" and the distance between the tips 30 on the hammer springs 108 and 110 to 0.192". At the same time the distance between the tips 30 on the hammer springs 106 and 108 is increased to 0.208".

The hammer springs 104 and 106 form a first pair of hammer springs, and the hammer springs 108 and 110 form a second pair of hammer springs. The alternate shifting of the positions of the various hammer springs in the arrangement of FIG. 12 divides the hammer springs into different pairs in this manner. The tips 30 on each pair of hammer springs are spaced apart by a first fixed distance which is the distance 0.192". The distance between the tip 30 on each hammer spring of each pair and the adjacent hammer spring of the next pair along the length of the hammer bank 10 is the distance of 0.208". The difference between the distances 0.28" and 0.192" which is 0.16" is equal to the distance traveled by the hammer bank 10 across the paper 18 during each 710 microsecond cycle. Accordingly, the hammer springs 106 and 110 in the second plurality are shifted by 0.008" relative to the adjacent hammer springs 104 and 108 in the first plurality, when compared with the uniform 0.200" spacing shown in FIG. 11. This change of 0.008" corresponds to the distance traveled by the hammer bank 10 across the paper 18 during a 355 microsecond half cycle of each cycle, thereby compensating for the fact that the hammer springs 106 and 110 are fired one-half of a cycle after the hammer springs 104 and 108 are eligible to be fired.

The various hammer springs such as the springs 104, 106, 108 and 110 illustrated in FIG. 12 can be mounted generally vertically along the length of the hammer bank 10 and at the same time provided with the spacings between the impact tips 30 shown in FIG. 12. In the case where the hammer springs are already mounted along the hammer bank 10 to have uniform spacing between the tips 30 as shown in FIG. 11, it may be a simple matter to modify the mountings of the various hammer springs so as to achieve the spacings shown in FIG. 12. Where each hammer spring is mounted on the magnetic insert 50 by a single bolt 112, the various hammer spring mounting bolts 112 are loosened and the top ends of the hammer springs are repositioned using a jig or other appropriate apparatus to achieve the particular spacings shown in FIG. 12. When such spacings are achieved, the various bolts 112 are tightened securely.

Figure 13:
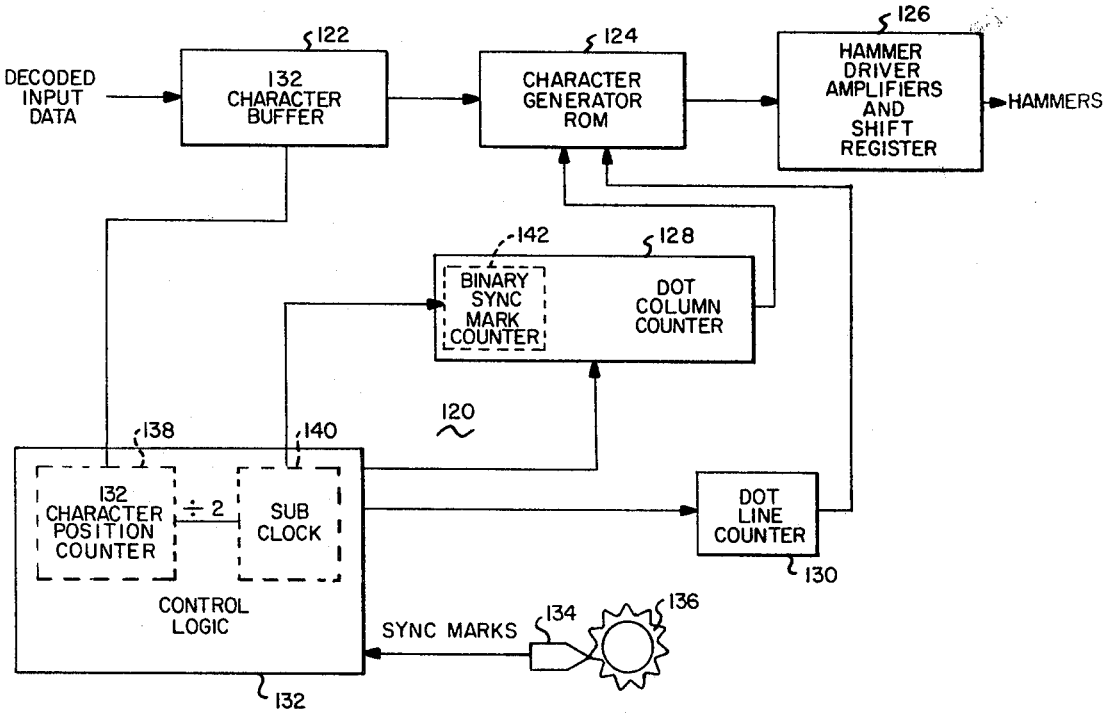
FIG. 13 is a simplified block diagram of an electronic control system that may be used in conjunction with systems in accordance with the invention.

FIG. 13 is a block diagram of an electronic control system 120 that may be used in conjunction with systems in accordance with the invention in which the various hammer springs are arranged as shown in FIG. 12. The electronic control system 120 is very similar to the electronic control system shown in FIG. 9 of the previously referred to U.S. Pat. No. 3,941,051 Barrus et al. As such the electronic control system 120 includes a 132 character buffer 122, a character generator ROM 124 and hammer driver amplifiers and shift register 126. After being decoded, a line of input data which represents a maximum of 132 characters is entered into successive character positions in the 132 character buffer 122. The 132 character buffer 122 presents the characters to the character generator ROM 124, which decodes the individual characters into corresponding dot patterns for each character. These dot patterns are generated serially in accordance with the dot line and dot column counts, as described hereafter. The dot pattern signals are coupled to the hammer driver amplifiers and shift register 126. Each of the hammer driver amplifiers in the circuit 126 is coupled to control a different hammer spring in the hammer bank. There is one hammer driver amplifier for each of the hammer springs, and the 132 character patterns that are generated from the character generator ROM 124 are successively cycled in 66 sets of two conventional shift register circuits contained within the hammer driver amplifiers and shift register 126. This is because there are 66 hammer springs in the hammer bank 10 of the present example, with each hammer spring 26 being used to print two of the characters in the line of characters.

To control the character generator ROM 124, a dot column counter 128 and a dot line counter 130 are each operated by control logic 132 in response to the positional and cycle signals derived by a magnetic pickup 134. As described in the previously referred to Barrus el at. patent, the magnetic pickup 134 generates sync marks in response to the teeth of an encoder wheel 136 which rotates in controlled fashion as the shuttle 12 sweeps across the paper 18. In the present example 24 sync marks are generated with each pass of the shuttle 12 across the paper 18. The first 12 such sync marks correspond to the 12 different half dot positions comprising the width of a first character to be printed by each hammer spring. The remaining 12 sync marks correspond to the 12 half dot positions comprising the width of the second character to be printed by each hammer spring. Special indicia on the encoder wheel 136 are sent by the magnetic pickup 134 and are passed by the control logic 132 to activate the dot line counter 130. In this manner the dot line counter 130 is advanced at the completion of each pass of the shuttle 12 across the paper 18 in one direction or the other.

The sync marks detected by the magnetic pickup 134 are applied, after shaping and timing in the control logic 132, to the dot column counter 128, to divide the horizontal movement of the shuttle mechanism into accurately demarcated positional increments. The dot column counter 128 is advanced with each sync mark from the magnetic pickup 134 in one direction of shuttle movement and decremented one count for each sync mark in the other direction of shuttle movement. Thus, for each character position of the character generator ROM 124, a dot printing impulse is or is not coupled to the hammer driver amplifiers and shift register 126, depending upon the counts presented by the dot column counter 128 and the dot line counter 130 respectively.

The control logic 132 includes a 132 character position counter 138 and a sub clock 140. Each time the magnetic pickup 134 senses a sync mark denoting a new dot position, the 132 character position counter 138 responds by generating 132 pulses causing the character buffer 122 to cycle through all 132 of the characters stored therein and comprising a given line. The sub clock 140 divides the frequency of the 132 character position counter 138 by 2 so as to generate 66 pulses in response to each sync mark. Because of the 66 hammer springs in the present example is capable of printing two of the 132 possible characters in each line, the output of the sub clock 140 serves to define each of the 66 pairs of characters in the line which are being processed by the character buffer 122, the character generator ROM 124 and the hammer driver amplifiers and shift register 126.

As previously noted the dot column counter 128 serves to identify the dot position denoted by each of the 24 sync marks for each of the 132 characters from the character buffer 122 converted into dot patterns by the character generator ROM 124 under the control of the 132 pulse character position counter 138. As previously described in connection with FIG. 12, alternate ones of the hammer springs 26 such as the hammer springs 106 and 110 are eligible for firing one-half cycle (355 microseconds) after the remaining hammer springs including the hammer springs 104 and 108 are eligible to be fired. During each half cycle of 355 microseconds, the shuttle 12 moves across the paper 18 by an amount equal to the distance between a pair of half dot positions on the paper 18. Travel of the shuttle 12 across the paper 18 by a half dot position is marked by the sensing of a new sync mark by the magnetic pickup 134. Each time the various hammer springs 26 are made eligible for firing at a given dot location on the paper 18, the same hammers are not eligible for firing until a full dot position later which is represented by the occurrence of two sync marks. However, because in the example of FIG. 12 alternate ones of the hammer springs 26 are displaced from the remaining ones of the hammer springs 26 by a distance corresponding to a half dot position, it is necessary to make alternate ones of the hammer springs 26 eligible for firing a half dot position after the remaining ones of the hammer springs 26 are made eligible for firing. Thus, in the particular example of FIG. 12 the hammer springs 106 and 110 must be made eligible for firing a half dot position after the hammer springs 104 and 106 are eligible to be fired. This is accomplished by a binary sync mark counter 142 which is contained within the dot column counter 128 and which is responsive to the pulses generated by the sub clock 140. The binary sync mark counter 142 causes the output of the dot column counter 128 to be a half dot position behind in response to alternate ones of the pulses from the sub clock 140. As previously noted and sub clock 140 effectively operates to divide the 132 characters in each line into 66 different character pairs. Each character pair is printed by a different one of the 66 hammer springs 26 in the shuttle 12. Accordingly, when the pulses from the sub clock 140 which are applied to the binary sync mark counter 142 represent the pairs of characters to be printed by the hammer springs 104 and 108 in FIG. 12, the dot column counter 128 provides to the character generator ROM 124 the dot column positions therefor. However, when the pulses from the sub clock 140 representing the hammer springs 106 and 110 of FIG. 12 are applied to the binary sync mark counter 142, the dot column positions represented to the character generator ROM 124 are artificially shifted by a half dot position so that such hammers are not eligible for firing until a half cycle (355 microseconds) later. In this matter the dot column counter 128 represents alternate pairs of the characters as being "on time" or "delayed a half cycle." The alternate hammer springs which are artificially repositioned upstream by a half dot position or the equivalent of one-half a firing cycle relative to the remaining hammer springs.

While the invention has been particularly shown and described with reference to a preferred embodiment thereof, it will be understood by those skilled in the art that various changes in form and details may be made therein without departing from the spirit and scope of the invention.

What is claimed is:

1. In an impact printer in which a hammer bank is capable of undergoing movement relative to a printable medium, the hammer bank comprising a plurality of hammer springs mounted in side-by-side relation along a portion of the hammer bank, each of the hammer springs having an impact tip mounted thereon for impacting the printable medium when the hammer spring is released, each of the hammer springs forming a part of a magnetic hammer spring release circuit and disposed to contact a different one of a plurality of pole pins, each having an energizable coil thereon, the improvement comprising an arrangement mounting the hammer springs on the hammer bank to form the hammer springs into pairs along the hammer bank with each of the pairs comprising a first hammer spring and a second hammer spring, the impact tips of the first and second hammer springs of each of the pairs being separated by approximately a first fixed distance and the impact tip on each hammer spring of each of the pairs of the hammer springs being separated by approximately a second fixed distance from the impact tip on an adjacent hammer spring of an adjacent one of the pairs of the hammer springs, the second fixed distance being greater than the first fixed distance.

2. The invention set forth in claim 1, further including means defining a succession of hammer spring release cycles as the hammer bank moves relative to the printable medium, means responsive to data to be printed for releasing selected ones of the first hammer springs of each of the pairs of hammer springs at the beginning of each of the release cycles and means responsive to data to be printed for releasing selected ones of the second hammer springs of each of the pairs of hammer springs at a time approximately halfway through each of the release cycles.

3. The invention set forth in claim 2, wherein the difference between the first fixed distance and the second fixed distance is approximately equal to the distance traveled by the hammer bank relative to the printable medium during each of the release cycles.

4. A hammer bank for use in an impact printer comprising the combination of a common magnetic mounting structure, a plurality of pole pins mounted in spaced-apart relation along the common magnetic mounting structure, a plurality of coils, each being mounted on a different one of the pole pins, a permanent magnet coupled to the common magnetic mounting structure, a plurality of elongated, resiliently flexible hammer springs mounted in spaced-apart relation along the common magnetic mounting structure at lower ends thereof and disposed adjacent different ones of the pole pins at upper ends thereof, and a plurality of impact tips, each mounted on a different one of the hammer springs adjacent the upper end thereof, the hammer springs being mounted so that alternate ones of the hammer springs have the upper ends thereof disposed substantially closer an adjacent hammer spring on one side thereof than to an adjacent hammer spring on the other side thereof.

5. The invention set forth in claim 4, wherein the impact tip on each of the alternate ones of the hammer springs is spaced apart from the impact tip on the hammer spring on one side thereof by a first distance and from the impact tip on the hammer spring on the other side thereof by a second distance different from the first distance.

6. An impact printer comprising the combination of a printable medium, a hammer bank, means for moving the hammer bank across the printable medium, means defining a succession of hammer release cycles as the hammer bank is moved across the printable medium, a plurality of hammer springs mounted on the hammer bank in spaced-apart relation along a portion of the hammer bank, a plurality of magnetic circuits sharing at least one common element and mounted within the hammer bank, each of the magnetic circuits being operative to release a different one of the hammer springs for impacting of the printable medium and means responsive to data to be printed for controlling the magnetic circuits to release selected ones of alternate ones of the hammer springs at the beginning of each of the succession of hammer release cycles and to release selected ones of the remaining ones of the hammer springs at a point partway through each of the succession of hammer release cycles.

7. The invention set forth in claim 6, wherein each of the alternate ones of the hammer springs is spaced apart by a first uniform distance from an adjacent one of the remaining ones of the hammer springs on a first side thereof and by a second uniform distance different from the first uniform distance from an adjacent one of the remaining ones of the hammer springs on an opposite second side thereof.

8. A hammer bank for use in an impact printer comprising the combination of an elongated magnetic return path member, an elongated permanent magnet coupled to the magnetic return path member at a lower end of the magnetic return path member, a plurality of pole pieces mounted in spaced-apart relation along the magnetic return path member at an upper end of the magnetic return path member opposite the lower end, a plurality of coils, each mounted on a different one of the pole pieces, a plurality of elongated resilient hammer springs, each being mounted on the hammer bank adjacent the permanent magnet at a lower end of the hammer spring and having an opposite upper end of the hammer spring disposed adjacent a different one of the pole pieces, and a plurality of impact tips, each mounted on a different one of the hammer springs at the upper end thereof, each of the impact tips being a first fixed distance from an impact tip on an adjacent hammer spring on one side thereof and a second fixed distance from an impact tip on an adjacent hammer spring on a side thereof opposite from said one side, the first fixed distance being substantially different from the second fixed distance.

9. The invention set forth in claim 8, wherein each of the hammer springs is normally held in a retract position against an adjacent one of the pole pieces by the permanent magnet, and further including a circuit for selectively energizing the coils on the pole pieces, the circuit being capable of energizing any of alternate ones of the coils at a first given instant and of energizing any of the remaining ones of the coils at a second given instant different from the first given instant.

10. The invention set forth in claim 9, wherein the second given instant occurs long enough after the first given instant to allow any hammer springs released by energizing coils at the first given instant to impact a printable medium and at least begin their return to the retract position.

11. An impact printer system comprising the combination of a printable medium, means defining a succession of dot positions along a line across the printable medium, a hammer bank having a plurality of hammers along the length thereof, each of the hammers having a dot printing impact tip mounted thereon, means for moving the hammer bank relative to the printable medium to move the dot printing impact tips of the hammers along said line across the printable medium, a common magnetic structure coupled to each of the hammers in the hammer bank, means for normally providing a magnetic flux through each hammer and into the common magnetic structure in a first direction to hold the hammers in a retract position, means for providing a magnetic flux through the common magnetic structure to each hammer in a second direction opposite said first direction when the hammer is to be released for impact of the printable medium, and means for spacing the dot printing impact tips along the length of the hammer bank so that alternate ones of the dot printing impact tips are at the dot positions at each of a succession of instants as the hammer bank is moved across the printable medium and the remaining ones of the dot printing impact tips are at the dot positions at each of a succession of instants between said first-mentioned instants as the hammer bank is moved across the printable medium.

* * * * *

UNITED STATES PATENT AND TRADEMARK OFFICE

CERTIFICATE OF CORRECTION

PATENT NO. : 4,386,563

DATED : June 7, 1983

INVENTOR(S) : Norman E. Farb

It is certified that error appears in the above-identified patent and that said Letters Patent are hereby corrected as shown below:

In the Abstract, line 16, after "is" and before "in", "released" should read --realized--. Column 1, line 36, after "hammer" and before "in", "spring" should read --springs--; line 36, after "position" and before "the", "oagainst" should read --against--. Column 4, line 54, after "invention", the period (".") should read a semicolon --;--. Column 6, line 54, after "permanent" and before "48", "magent" should read --magnet--. Column 7, line 38, after "are" and before "saturated", "magneticlly" should read --magnetically--; line 48, after "action", "occurrng" should read --occurring--. Column 10, line 2, after "occurs" and before "the", "of" should read --at--. Column 11, line 37, after "is" (first occurrence), " 0.16" " should read --0.016"--. Column 12, line 25, after "two" and before "conventional" insert --by--; line 27, after "springs" and before "in" insert --26--. Column 13, line 53, after "noted", "and" should read --the--.

Signed and Sealed this

*Thirtieth* Day of *August 1983*

[SEAL]

*Attest:*

GERALD J. MOSSINGHOFF

*Attesting Officer*

*Commissioner of Patents and Trademarks*